US009870699B2

(12) United States Patent
Ujike et al.

(10) Patent No.: US 9,870,699 B2
(45) Date of Patent: Jan. 16, 2018

(54) BATTERY-POWERED SECURITY SENSOR SYSTEM

(71) Applicant: OPTEX CO., LTD., Shiga (JP)

(72) Inventors: Takao Ujike, Otsu (JP); Katsutoshi Tatsuoka, Otsu (JP); Hiroshi Makino, Otsu (JP); Mitsugu Mihara, Otsu (JP); Shinya Nishimura, Otsu (JP)

(73) Assignee: OPTEX CO., LTD., Shiga (JP)

( * ) Notice: Subject to any disclaimer, the term of this patent is extended or adjusted under 35 U.S.C. 154(b) by 81 days.

(21) Appl. No.: 14/582,865

(22) Filed: Dec. 24, 2014

(65) Prior Publication Data

US 2015/0187195 A1 Jul. 2, 2015

(30) Foreign Application Priority Data

Dec. 26, 2013 (JP) ..... 2013-269083

(51) Int. Cl.
*G08B 23/00* (2006.01)
*G08B 29/18* (2006.01)
*G08B 13/183* (2006.01)

(52) U.S. Cl.
CPC ..... *G08B 29/181* (2013.01); *G08B 13/183* (2013.01)

(58) Field of Classification Search
CPC ..... G08B 17/00; G08B 17/10; G08B 25/10; F21V 23/0442; F21V 33/0076; F21W 2131/10; G05F 1/14; A45C 11/184; G01N 33/0062; G01R 27/22
USPC ..... 340/693.1, 693.3; 307/46
See application file for complete search history.

(56) References Cited

U.S. PATENT DOCUMENTS 4,982,176 A * 1/1991 Schwarz ..... F21S 9/032 136/291
5,150,100 A * 9/1992 Black ..... G08B 29/02 250/227.11
6,078,269 A * 6/2000 Markwell ..... G08B 17/11 340/517
8,431,899 B2 4/2013 Tatsuoka
2003/0009202 A1* 1/2003 Levine ..... A61B 5/0031 607/58
2005/0083147 A1* 4/2005 Barr ..... H01P 3/088 333/33
2005/0083174 A1* 4/2005 Nakamura ..... B60R 25/246 340/5.72
2012/0006988 A1 1/2012 Tatsuoka
2013/0099922 A1* 4/2013 Lohbihler ..... G08B 13/184 340/539.17

(Continued)

FOREIGN PATENT DOCUMENTS

JP 2012-018034 A 1/2012
JP 2013-127671 A 6/2013

*Primary Examiner* — George Bugg
*Assistant Examiner* — Anthony D Afrifa-Kyei
(74) *Attorney, Agent, or Firm* — Studebaker & Brackett PC

(57) ABSTRACT

A security sensor system is provided which allows the stopping of the device due to the end of a battery life to be postponed by suppressing battery power consumption, which is caused due to an object detection operation of the security sensor system, after a low battery state is detected. The security sensor system is powered by a battery. When a low battery detector detects a reduction in the voltage of the battery, an object detection operation of the security sensor system is switched from a normal mode to a suppression mode. Consumption of the battery in the suppression mode is suppressed.

9 Claims, 7 Drawing Sheets

(56) References Cited

U.S. PATENT DOCUMENTS

| | | | | |
|---|---|---|---|---|
| 2014/0240138 | A1* | 8/2014 | Lee | H04M 1/7253<br>340/636.1 |
| 2014/0240503 | A1* | 8/2014 | Buckley | G08B 13/26<br>348/152 |
| 2015/0170505 | A1* | 6/2015 | Frew | G08B 25/10<br>340/539.22 |

* cited by examiner

BATTERY-POWERED SECURITY SENSOR SYSTEM

CROSS REFERENCE TO THE RELATED APPLICATION

This application is based on and claims Convention priority to Japanese patent application No. 2013-269083, filed Dec. 26, 2013, the entire disclosure of which is herein incorporated by reference as a part of this application.

BACKGROUND OF THE INVENTION

Field of the Invention

The present invention relates to a battery-powered security sensor system which detects an object to provide or output a warning signal or an alarm signal.

Description of Related Art

As a security sensor system, there is known an AIR (active infrared ray) sensor and a PIR (passive infrared ray) sensor which detect an object through a detection beam such as an infrared ray. In a battery-powered security sensor system having a battery a voltage of the battery is monitored to detect a low battery state, that is, a reduction in battery voltage. When the low battery state is detected during the monitoring, the low battery state is notified by wireless transmission. The security sensor system may control the transmission of the low battery state notification so as to suppress battery power consumption which is caused by the transmission (JP Laid-open Patent Publication No. 2013-127671).

In general, the security sensor system is managed by a control unit in a centralized manner. Upon a notification signal indicative of the low battery state is received by the control unit, an engineer goes to a location where the security sensor system is installed to replace a battery, for which a low battery state is detected, with a new battery. However, in some cases, an engineer cannot immediately go to the installation location, so that it takes considerable time from detection of the low battery state to battery replacement. If the battery goes dead before battery being replaced, the security sensor system would be stopped.

In the device described in the above JP Laid-open Patent Publication No. 2013-127671, in order to postpone the stopping of the device due to the end of the battery life, transmission of a low battery state notification signal is controlled to suppress battery power consumption, but the security sensor system continues a normal object detection operation. Since the security sensor system considerably consumes the battery by the normal object detection operation, battery voltage is substantially decreased even after detection of a low battery state. As such, the battery replacement may not in time, and thus the security sensor system may be stopped.

SUMMARY OF THE INVENTION

An object of the present invention is to provide a security sensor system which allows the stopping of the device due to the end of a battery life to be postponed by suppressing battery power consumption, which is caused due to an object detection operation of the security sensor system, after a low battery state is detected.

In order to attain the above-described object, a security sensor system according to one aspect of the present invention is powered by a battery, the security sensor system including: an object sensor to generate an object detection signal when detecting an object; an output interface module to provide or output a warning signal; a controller to receive the object detection signal generated by the object sensor, which controller controls the output interface module in accordance with the object detection signal to cause the output interface module to provide the warning signal; a low battery detector to detect a reduction in a voltage of the battery; and an operation mode switcher to switch an object detection operation of the security sensor system from a normal mode to a suppression mode when the low battery detector detects a reduction in the voltage of the battery. Consumption of the battery in the suppression mode is suppressed.

Here, the "object detection operation of the security sensor system" means an operation related to a security function. An operation of providing a warning or an alarm is also included in the "object detection operation of the security sensor system". In addition, the "object detection operation of the security sensor system" includes not only an operation related directly to object detection but also an operation which assists in object detection. Examples of such an operation include an operation which is not essential for object detection but improves the accuracy of object detection. An operation which is not related to a security function is not included in the object detection operation of the security sensor system. For example, an operation related to the battery life of the security sensor system such as an operation related to low battery detection is not included in the object detection operation.

According to this configuration, when a reduction in the voltage of the battery is detected, since the object detection operation of the security sensor system is switched to the operation in the suppression mode, it is possible to postpone the stopping of the device due to the end of a battery life. In particular, the electronic power of a battery mounted on the security sensor system is mainly consumed in the object detection operation, and thus by switching the object detection operation to the operation in the suppression mode, it is possible to effectively postpone the stopping of the device due to the end of a battery life.

In general, a security sensor system operates with a margin to avoid a false alarm or missing of an alarm. Therefore, even when the object detection operation of the security sensor system is switched to the suppression mode, a false alarm or missing of an alarm rarely occurs. Thus, by switching the operation to the suppression mode, it is possible to suppress the power consumption of the battery without significantly impairing the object detection performance.

In a preferred embodiment, the security sensor may further include a microcomputer. The controller may be implemented in the microcomputer. By lengthening a period of sampling, in the microcomputer, the object detection signal supplied to the controller, the operation mode switcher switches the object detection operation of the security sensor system from the normal mode to the suppression mode. According to this configuration, by lengthening the sampling period, it is possible to easily and effectively suppress the power consumption of the battery. When the sampling period is lengthened, the operation of the security sensor system may become slow. However, after detection of a low battery state, by prioritizing suppression of the battery power consumption over the operation speed, it is possible to postpone the stopping of the device due to the end of a battery life.

In a preferred embodiment, the security sensor system may further include an input interface module to accept an input concerning an operation condition of the security sensor system. The controller may monitor the input accepted by the input interface module while the object detection operation is in the normal mode. By leaving off the monitoring of the input, the operation mode switcher switches the object detection operation of the security sensor system from the normal mode to the suppression mode. According to this configuration, by leaving off the monitoring of the input, it is possible to easily suppress the power consumption of the battery. While the monitoring of the input is left off as described above, it is impossible for a user to set an operation condition, and thus the convenience of the security sensor system is decreased. However, after detection of a low battery state, by prioritizing suppression of the battery power consumption over the convenience, it is possible to postpone the stopping of the device due to the end of a battery life.

The monitoring of the input accepted by the input interface module corresponds to an operation which assists in object detection since the input interface module accepts an input of an operation condition of the security sensor system. Therefore, the monitoring of the input accepted by the input interface module is included in the above "object detection operation of the security sensor system".

In a preferred embodiment, the object sensor may include a first object detection portion and a second object detection portion. Both the first and second object detection portions are operated in the normal mode. In the normal mode, it may be determined that an object is detected when both of or either one of the object detection portions detect an object. By leaving off either one of the first and second object detection portions, the operation mode switcher switches the object detection operation of the security sensor system from the normal mode to the suppression mode, such that, in the suppression mode, the object sensor determines that an object is detected when the other object detection portion of the first and second object detection portions detects an object. According to this configuration, by leaving off the one of the first and second object detection portions, it is possible to easily and effectively suppress the power consumption of the battery.

Preferably, the object sensor includes: a detection beam projector that intermittently transmits a detection beam for object detection toward a detection area; and a detection beam receiver that receives the detection beam. The object sensor may include an active type object sensor that detects an object on the basis of shield or reflection of the detection beam due to the object to generate the object detection signal.

In a further preferred embodiment, by controlling the detection beam projector so as to execute at least one of: decreasing an amplitude of the detection beam; lengthening an interval of the intermittent detection beam; and shortening an output time of the detection beam, the operation mode switcher switches the object detection operation of the security sensor system from the normal mode to the suppression mode. According to this configuration, by reducing the power of the detection beam, it is possible to easily and effectively suppress the power consumption of the battery.

According to another further preferred embodiment, the security sensor system further includes: an amplifier to amplify a detection beam reception signal from the detection beam receiver; and an automatic gain control circuit for adjusting a gain of the amplifier. By reducing a range of adjustment of the gain by the automatic gain control circuit, the operation mode switcher switches the object detection operation of the security sensor system from the normal mode to the suppression mode. Here, "reducing a range of adjustment of the gain" means to bring the automatic gain control circuit into a low consumption current state, and also includes setting the gain to zero, that is, leaving off adjustment of the gain. According to this configuration, by reducing the range of adjustment of the gain, it is possible to easily and effectively suppress the power consumption of the battery. By reducing the automatic gain control function, which is an auxiliary function of the device, as described above, it is possible to postpone the stopping of the device due to the end of a battery life.

In a preferred embodiment, the object sensor includes an infrared receiver that receives an infrared ray emitted by an object within a detection area. The object sensor may include a passive type object sensor that detects an object on the basis of the received infrared ray to generate the object detection signal.

In a preferred embodiment, the infrared receiver further includes a masking detector to detect a reflected beam from an object. By limiting the masking detection function of the masking detector or the anti-masking function, the operation mode switcher switches the object detection operation of the security sensor system from the normal mode to the suppression mode. Here, "limiting the masking detection function of the masking detector" includes not only reducing the power of light emission for masking detection but also setting the power to zero to leave off the masking detection. According to this configuration, by limiting the masking detection function of the masking detector, it is possible to easily and effectively suppress the power consumption of the battery. By limiting the masking detection function or the anti-masking function, which is an auxiliary function of the device, as described above, it is possible to postpone the stopping of the device due to the end of a battery life.

The masking detection function of the masking detector corresponds to an operation which assists in object detection, since the masking detection is for preventing missing of an alarm or alarm failures by the security sensor system. Therefore, the detection function of the masking detection portion is included in the above "object detection operation of the security sensor system".

In a preferred embodiment, the warning signal may be wirelessly transmitted as a pulse signal having a predetermined interval, via a wireless transmitter. By controlling the output interface module so as to execute at least one of: lengthening the predetermined interval; and wirelessly transmitting the pulse signal only a certain number of times before leaving off the transmission, the operation mode switcher switches the object detection operation of the security sensor system from the normal mode to the suppression mode. According to this configuration, since the interval of the pulses of the warning signal is lengthened and/or the pulse signal is wirelessly transmitted only a certain number of times before leaving off the transmission, it is possible to easily and effectively suppress the power consumption of the battery.

The wireless transmission of the warning signal as a pulse signal having a predetermined interval via the wireless transmitter is for providing an alarm, and thus is included in the above "object detection operation of the security sensor system".

Furthermore, the security sensor system may further include a battery saving function input interface to accept an input of either one of enablement and disablement. Only if the battery saving function input interface is enabled, the operation mode switcher may switch the object detection operation of the security sensor system from the normal mode to the suppression mode.

In a preferred embodiment, the output interface module includes an indicator that provides the warning signal as a visible display or a visible indicator. By leaving off the visible display of the warning signal, the operation mode switcher switches the object detection operation of the security sensor system from the normal mode to the suppression mode. According to this configuration, by leaving off the visible display of the warning signal, it is possible to easily and effectively suppress the power consumption of the battery. Since the warning signal is wirelessly transmitted via the wireless transmitter, an alarm can be provided even when the visible display is not performed. By dispensing with the auxiliary visible display as described above, it is possible to postpone the stopping of the device due to the end of a battery life.

The visible display of the warning signal is not included in an operation related directly to object detection, but is in an operation of providing an alarm and thus is included in the above "object detection operation of the security sensor system".

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

Hereinafter, embodiments of the present invention will be described with reference to the drawings.

Figure 1:
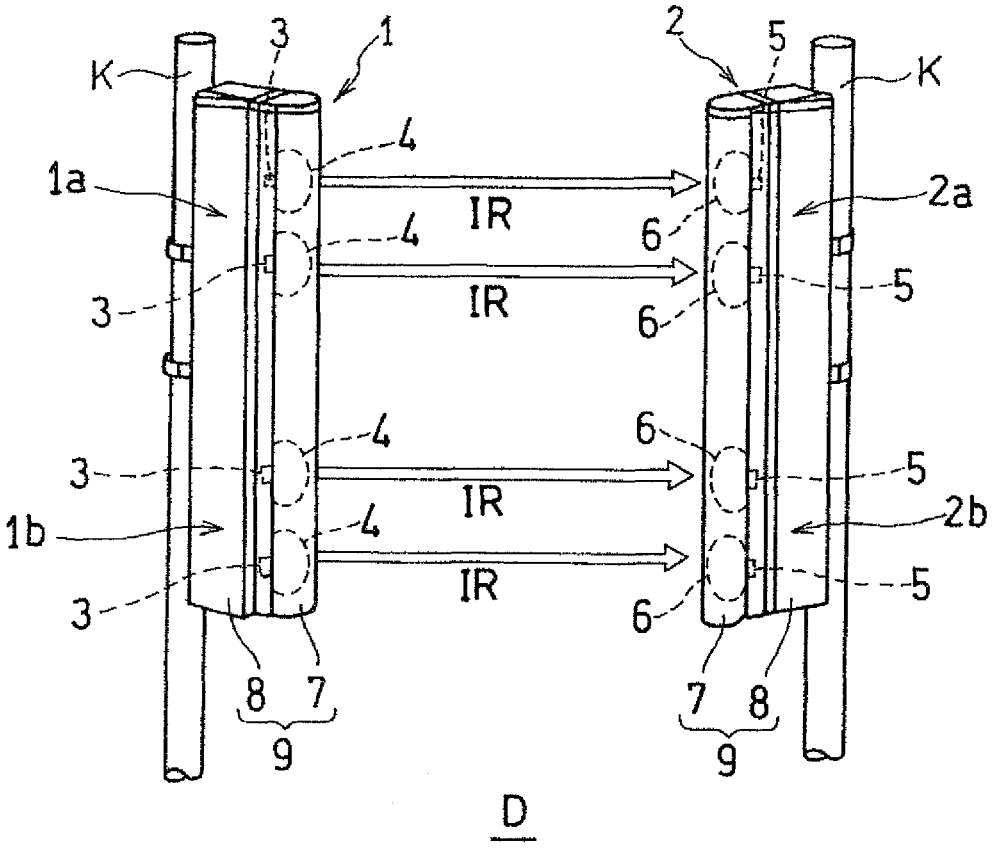
FIG. 1 is a perspective view showing a security sensor system according to a first embodiment of the present invention.

FIG. 1 shows a security sensor system D according to a first embodiment of the present invention. The security sensor system D is configured to detect an object such as a human body to output a warning signal. The security sensor system D includes an AIR sensor. The AIR sensor includes: a beam projecting unit 1 powered by a battery; and a beam receiving unit 2 powered by a battery which is different from the battery powering the unit 1. The beam receiving unit 2 is disposed in face to face relation with the beam projecting unit 1.

Each of the beam projecting unit 1 and the beam receiving unit 2 of the security sensor system D includes a casing 9 which includes a sensor covering 7 and a back box 8. The beam projecting unit 1 includes a pair of beam projectors 1*a*, 1*b* disposed in the vertical direction. The beam receiving unit 2 includes a pair of beam receivers 2*a*, 2*b* disposed in the vertical direction. Each of the beam projectors (detection beam projector) 1*a*, 1*b* includes a pair of upper and lower light emitting elements 3 disposed in the vertical direction and a pair of upper and lower light emitting lenses 4 disposed in the vertical direction. All of the light emitting elements 3 and light emitting lenses 4 are accommodated within the sensor covering 7. Each of the beam receivers (detection beam receiver) 2*a*, 2*b* also includes a pair of upper and lower light receiving elements 5 disposed in the vertical direction and a pair of upper and lower light receiving lenses 6 disposed in the vertical direction. All of the light receiving elements 5 and light receiving lenses 6 are accommodated within the sensor covering 7. Detection beams such as infrared rays IR emitted from the light emitting elements 3 are received by the light receiving elements 5, respectively.

The security sensor system D detects an object in a security area which is a substantially linear region connecting between the beam projecting unit 1 and the beam receiving unit 2. Specifically, when the infrared rays IR from the beam projecting unit 1 are intercepted by an object, the security sensor system D detects the object based on a change in the level of a signal (the amount of the infrared rays) received by the beam receiving unit 2, which is disposed opposite to the beam projecting unit 1, to output a warning signal. The beam projecting unit 1 and the beam receiving unit 2 are mounted on to-be-mounted portions K, K such as poles and walls.

Figure 2:
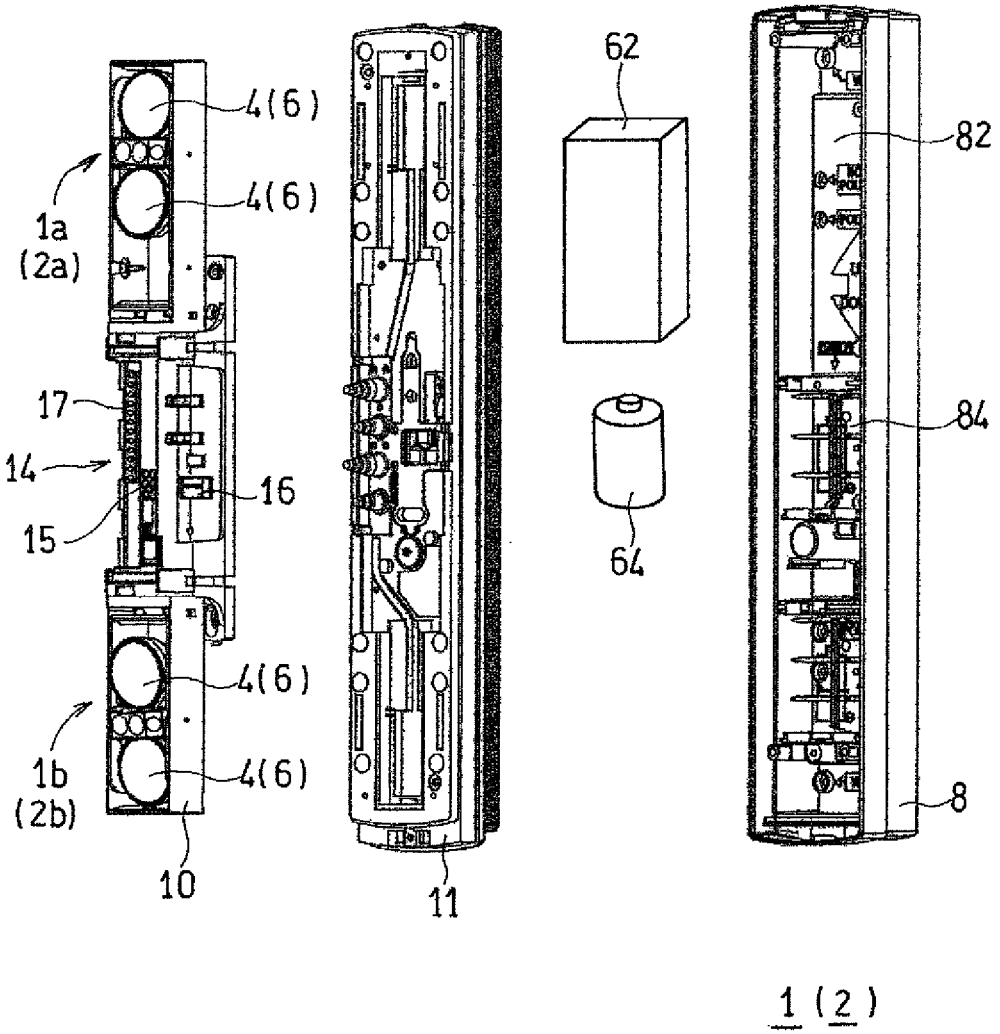
FIG. 2 is an exploded perspective view of the security sensor system in FIG. 1.

FIG. 2 illustrates the beam projecting unit 1 or the beam receiving unit 2, the sensor covering 7 being removed therefrom. The units 1 or 2 includes, in the back box 8, a wireless transmitter accommodation portion 82 configured to accommodate a wireless transmitter 62, and a battery holder 84 configure to hold a battery 64. The battery 64 functions as a driving power supply. The wireless transmitter 62 may be arbitrarily selected from commercially-available general-purpose wireless transmitters by a user.

The battery 64 may be any battery as long as it can be in a low battery state, that is, a voltage reduction state. For example, the battery 64 may be a chemical battery such as a primary battery or a secondary battery. Alternatively, the battery 64 may be a physical cell such as a solar cell. Although only one battery 64 is illustrated, a plurality of batteries 64 may be provided. In such a case, there is at least one battery that can be in a low battery state. The low battery state described later is detected for each battery that can be in a low battery state.

To the front side of the back box 8, a sensor body 10 is mounted via a sensor chassis 11. The sensor body 10 includes therein, for example, a circuit board including a microcomputer described later. The sensor body 10 includes an input/output interface 14 between the pair of beam projectors 1*a*, 1*b* (beam receivers 2*a*, 2*b*) disposed in the vertical direction. The input/output interface 14 includes an indicator portion 15, an input interface portion 16, and an output terminal portion 17 which are disposed in the lateral direction.

The indicator portion 15 may include, for example, an LED(s) and provides a warning signal by light emission. The indicator portion 15 may provide a signal indicative of a state of the security sensor system D (FIG. 1), in addition or alternative to the warning signal.

The input interface portion 16 may include one or more alternation switches which are manipulated by a user. The input interface portion 16 is used for switching or changing configurations such as object detection sensitivity and a detection area. The configurations are mainly set immediately after the security sensor system D (FIG. 1) is installed.

In addition to the input interface portion 16, a battery saving function alternating switch (battery saving function input interface), which is not shown, may be provided which is used to either enable or disable a suppression mode. As will be described later, an object detection operation of the security sensor system D (FIG. 1) after detection of a low battery state differs depending on whether the alternating switch is set to the enablement or the disablement.

The input interface portion 16 may further include a switch for turning on and off the indicator portion 15. Under the condition where the switch is turned on, the LED 15 emits light in accordance with a state of the security sensor system D (FIG. 1). On the other hand, under the condition where the switch is turned off, the LED 15 emits no light.

The output terminal portion 17 may include a terminal(s) for the circuit board in the sensor body 10. In the present embodiment, the wireless transmitter 62, which is accommodated in the wireless transmitter accommodation portion 82, is connected to the output terminal portion 17 via a wire which is not shown.

Figure 3:
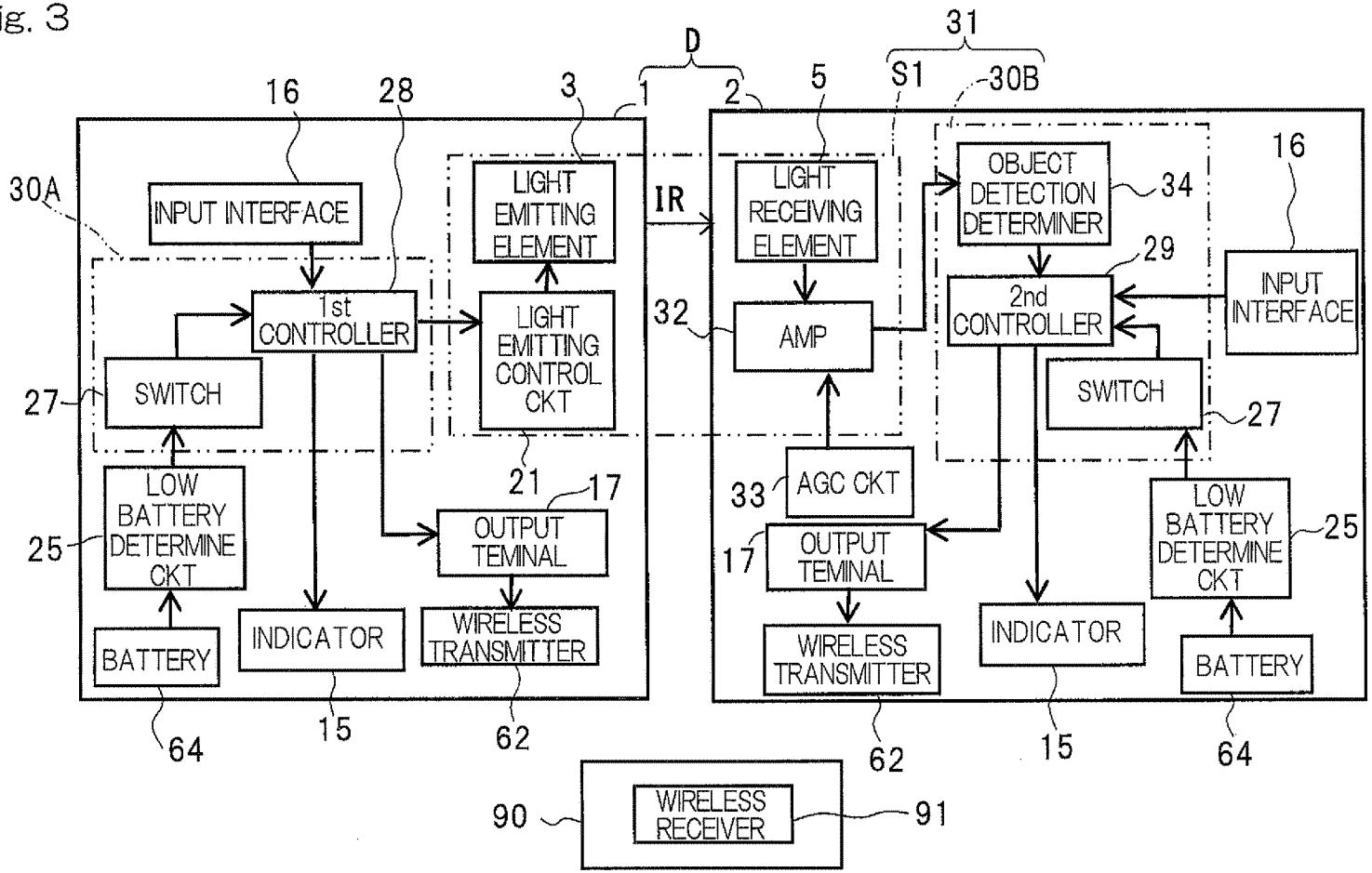
FIG. 3 is a schematic block diagram of the security sensor system in FIG. 1.

As shown in FIG. 3, a warning signal provided by the security sensor system D is monitored by a remote control unit 90. The sensor body 10 (FIG. 2) of the beam projecting unit 1 includes the indicator portion 15, the input interface portion 16, the output terminal portion 17, a first controller 28, the light emitting elements 3, a light emitting element control circuit 21, a low battery determination circuit (low battery detector) 25, and an operation mode switcher 27. The first controller 28 and the operation mode switcher 27 are implemented in a single microcomputer 30A. The wireless transmitter 62 and the battery 64 are disposed in back of the sensor body 10 (FIG. 2) as described above and are connected to the microcomputer 30A. The battery 64 supplies power to all the elements in the sensor body 10 (FIG. 2). That is, the battery 64 supplies power to the microcomputer 30A, the light emitting elements 3, and the other circuits. The wireless transmitter 62 may be supplied with power by the battery 64, or by a dedicated battery for the wireless transmitter 62.

The indicator portion 15, the input interface portion 16, and the output terminal portion 17 are connected to the first controller 28. The indicator portion (LED) 15 emits light under control of the first controller 28. The input interface portion 16 is manipulated by a user while the first controller 28 monitors an event of the manipulation. When the first controller 28 detects an event of the manipulation, the first controller 28 performs a process according to the manipulation. However, an event of a manipulation on the input interface portion 16 may be monitored by the first controller 28 only while the sensor covering 7 (FIG. 1) is opened. Opening of the sensor covering 7 (FIG. 1) may be detected by using a tamper switch which is not shown. The output terminal portion 17 connects the first controller 28 to the wireless transmitter 62.

The light emitting element control circuit 21 controls detection beams IR to be emitted from the light emitting elements 3. The light emitting element control circuit 21 changes its control in accordance with an instruction from the first controller 28. Although the beam projecting unit 1 includes the two beam projectors 1*a*, 1*b* (FIG. 2) each of which includes the pair of light emitting elements 3 as described above, FIG. 3 shows one of the light emitting elements 3 for the sake of simplification.

The low battery determination circuit 25 monitors the battery 64 to detect a low battery state thereof. For example, the low battery determination circuit 25 monitors the voltage between both ends of the battery 64, and when the voltage becomes equal to or less than a predetermined threshold, the low battery determination circuit 25 determines that the battery 64 is in a low battery state. When the low battery determination circuit 25 determines that the battery 64 is in a low battery state, a low battery detection signal is supplied to the operation mode switcher 27. Upon reception of the low battery detection signal from the low battery determination circuit 25, the operation mode switcher 27 switches an operation mode of the beam projecting unit 1 from a normal mode to the suppression mode in which power consumption of the battery 64 is suppressed. The normal mode and the suppression mode will be described later.

The sensor body 10 (FIG. 2) of the beam receiving unit 2 of the security sensor system D includes the indicator portion 15, the input interface portion 16, the output terminal portion 17, a second controller 29, a low battery determination circuit 25, an operation mode switcher 27, the light receiving elements 5, an amplifier circuit 32, an AGC (automatic gain control) circuit 33, and an object detection determiner 34. The second controller 29, the operation mode switcher 27, and the object detection determiner 34 are implemented in a single microcomputer 30B.

The indicator portion 15, the input interface portion 16, the output terminal portion 17, the low battery determination circuit 25, the operation mode switcher 27, the wireless transmitter 62, and the battery 64 in the beam receiving unit 2 are identical to those in the beam projecting unit 1.

The light receiving elements 5 receive the detection beams IR projected or emitted by the light emitting elements 3 of the beam projecting unit 1 to convert the detection beams IR to electrical signals. Then, the light receiving elements 5 input the electrical signals to the amplifier circuit 32. The light emitting elements 3 and the light emitting element control circuit 21 in the beam projecting unit 1 and the light receiving elements 5 and the amplifier circuit 32 in the beam receiving unit 2 form an AIR sensor S1. In the present embodiment, an object sensor 31 that serves as an object detection function includes the AIR sensor S1 and the object detection determiner 34. The amplifier circuit 32 amplifies the electrical signal inputted from each light receiving element 5. In this amplification, gain adjustment is automatically performed by the AGC circuit 33, so that the amplifier circuit 32 is controlled such that an output from the amplifier circuit 32 is continuously at a certain signal level or lower. The sensor signal amplified as described above is supplied to the object detection determiner 34 and the second controller 29. An analog signal supplied from the amplifier circuit 32 is converted to a digital signal by an A/D converter which is not shown. This A/D conversion is performed at a predetermined sampling period.

The object detection determiner 34 determines whether the level of the sensor signal supplied from the amplifier circuit 32 is equal to or lower than a set detection level. If the level is equal to or lower than the detection level, the object detection determiner 34 determines that an object is detected, and then supplies an object detection signal to the second controller 29. Upon reception of the object detection signal, the second controller 29 controls the indicator portion 15 and the wireless transmitter 62 to cause them to output a warning signal. The indicator portion (LED) 15 is controlled by the second controller 29 as described above, to provide an alarm or a warning through light emission by predetermined blinking or lighting.

To the wireless transmitter 62, the second controller 29 supplies a signal containing intermittent pulses having a predetermined interval, via the output terminal portion 17. Since the signal contains intermittent pulses as described above, for example, in the case where the wireless transmitter 62 is a commercially-available general-purpose transmitter which monitors a rising edge of a signal supplied thereto and generates a warning signal, the warning signal transmitted from the wireless transmitter 62 includes intermittent pulses having a predetermined interval T1 as shown in chart (a) of FIG. 4. The wireless transmitter 62 transmits the warning signal containing the intermittent pulses to a wireless receiver 91 of the control unit 90. Regarding output of these warning signals, in response to that the object detection determiner 34 continuously inputs an object detection signal to the second controller 29, the second controller 29 continuously controls the indicator portion 15 and the wireless transmitter 62 to cause them to output the warning signals.

On the basis of the configuration described above, the beam projecting unit 1 and the beam receiving unit 2 operate to function together as a security sensor system. These units 1, 2 operate in the normal mode until a low battery state is detected. An object detection operation of the security sensor system in the normal mode has a margin to avoid a false alarm or missing of an alarm.

Next, an object detection operation of the security sensor system D according to the present embodiment in the suppression mode after detection of a low battery state will be described. A common operation in the beam projecting unit 1 and the beam receiving unit 2 will be described with the beam projecting unit 1 as an example.

In the beam projecting unit 1, when the low battery determination circuit 25 detects a low battery state and a low battery detection signal is supplied to the operation mode switcher 27, the operation mode switcher 27 switches the operation mode from the normal mode to the suppression mode.

In the suppression mode, the first controller 28 leaves off monitoring of an event of a manipulation performed by a user on the input interface portion 16. That is, in the suppression mode, even when the input interface portion 16 is manipulated by a user, the first controller 28 does not perform a process according to the operation. For example, even when a user manipulates the input interface portion 16 in order to switch the object detection sensitivity or the detection area, neither the sensitivity nor the area can be changed. Thus, the convenience as the security sensor system may be decreased. Nevertheless, since monitoring of an event of a manipulation is left off, the power consumption of the battery 64 is suppressed.

It should be noted that in the case where monitoring of an event of a manipulation on the input interface portion 16 is performed only while the sensor covering (FIG. 1) is opened as described above, a period for monitoring of an event of a manipulation performed by a user on the input interface portion 16 is limited to a period when the sensor covering (FIG. 1) is opened in the normal mode.

Furthermore, in the suppression mode, an interval of signal transmission for alive monitoring may be longer than that in the normal mode. In order to indicate that each of the units 1, 2 of the security sensor system D is operating, an alive monitoring signal is transmitted from each of the beam projecting unit 1 and the beam receiving unit 2 via the wireless transmitter 62 to the control unit 90. In the suppression mode, the interval of the alive monitoring signal is lengthened from a predetermined interval in the normal mode. Thus, it is possible to suppress battery power consumption caused by signal transmission from the wireless transmitter 62.

The above-described operation in the suppression mode is common in the beam projecting unit 1 and the beam receiving unit 2. On the other hand, operations specific to the beam projecting unit 1 include the following operations.

Figure 5:
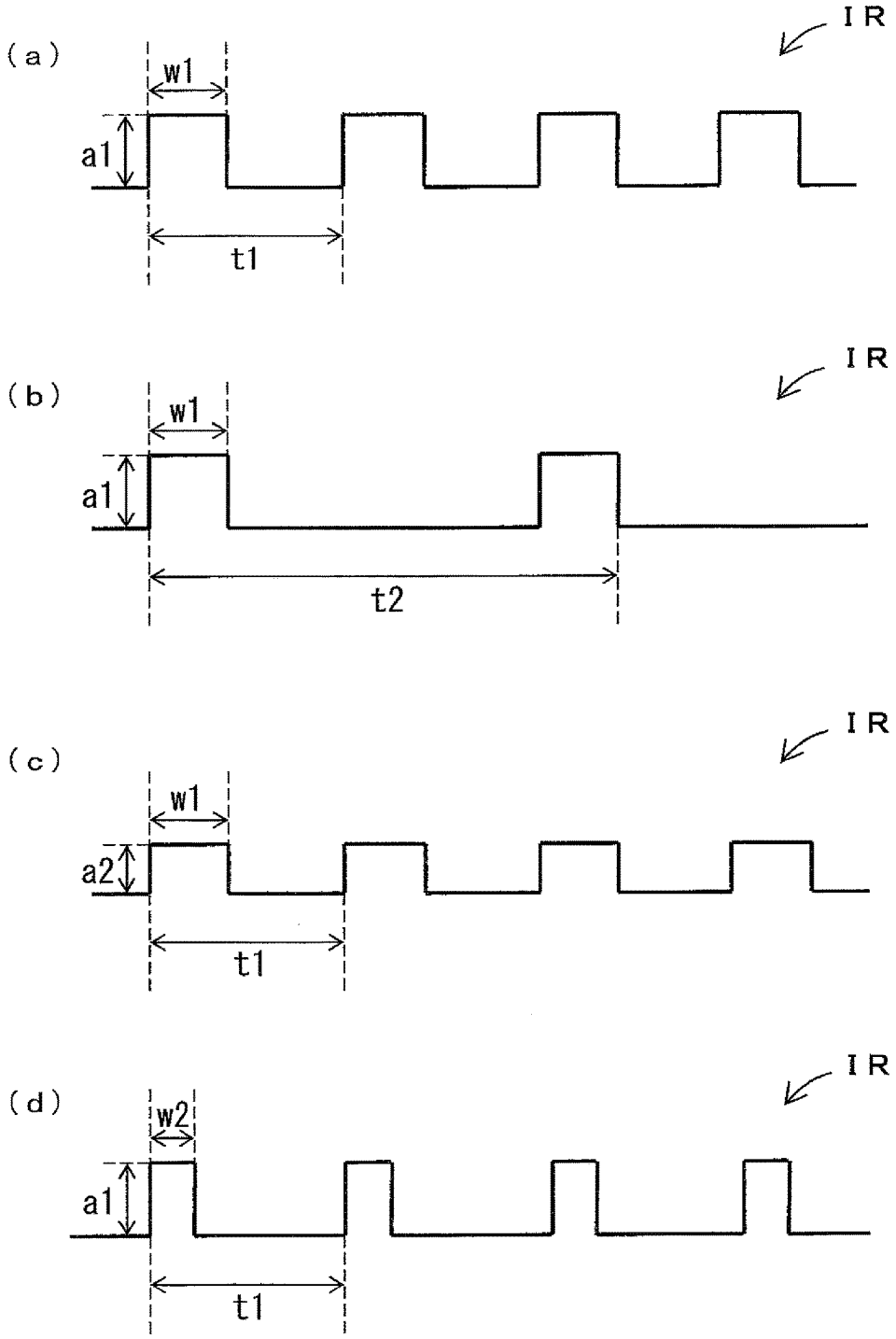
FIG. 5 is timing charts of a detection beam in the security sensor system in FIG. 1, in which chart (a) and charts (b) to (d) show timing in the normal mode and in the suppression mode, respectively.

In the normal mode, the light emitting element control circuit 21 controls each light emitting element 3, for example, to cause each light emitting element 3 to project or emit a detection beam IR containing intermittent pulses shown in chart (a) of FIG. 5. On the other hand, in the suppression mode, the first controller 28 provides an instruction to the light emitting element control circuit 21, so that the light emitting element control circuit 21 controls each light emitting element 3 in accordance with the instruction to reduce the power of the entire detection beam IR. Specifically, a pulse interval t1 may be changed to a longer pulse interval t2 as shown in chart (b) of FIG. 5; an amplitude a1 of each pulse may be changed to a smaller amplitude a2 as shown in chart (c) of FIG. 5; or an output time w1 of each pulse may be changed to a shorter output time w2 as shown in chart (d) of FIG. 5. Any combination of these pulse controls in charts (b) to (d) of FIG. 5 may be employed to reduce the power of the entire detection beam IR. By reducing the power of the detection beam IR as described above, the power consumption of the battery 64 can be suppressed. It should be noted that the detection beam IR in the normal mode shown in chart (a) of FIG. 5 has a margin to avoid missing of an alarm. Therefore, even if the detection beam IR is changed to one or any of those in the suppression mode shown in charts (b) to (d) of FIG. 5, missing of an alarm does not necessarily occur.

Operations specific to the beam receiving unit 2 in FIG. 3 include the following operations.

In the suppression mode, a range of adjustment of the gain of the AGC circuit 33 may be reduced. That is, a range of automatic adjustment of the gain is reduced such that the AGC circuit 33 is brought into a low consumption current state when the amplifier circuit 32 amplifies an electrical signal from the light receiving element 5. Reducing the range of adjustment of the gain may include setting the gain to zero, that is, not operating the AGC circuit 33. By limiting the AGC function which is auxiliary to the device D but greatly consumes the battery 64, it is possible to suppress the power consumption of the battery 64.

In the suppression mode, a period of sampling performed by the A/D converter (not shown) of the microcomputer 30B may be made longer than that in the normal mode. That is, while A/D conversion of an analog signal supplied from the amplifier circuit 32 is performed at a predetermined sampling period in the normal mode, the period is lengthened in the suppression mode. By lengthening the sampling period of an input signal in the microcomputer 30B as described above, the power consumption of the battery 64 is suppressed.

In the suppression mode, even when the second controller 29 receives an object detection signal from the object detection determiner 34, the second controller 29 may not perform control with respect to the indicator portion 15. That is, whereas, in the normal mode, upon reception of an object detection signal from the object detection determiner 34, the second controller 29 controls the indicator portion 15 such that the indicator portion 15 emits light; in the suppression mode, the second controller 29 does not perform such control. Thus, the power consumption of the battery 64 is suppressed. In the security sensor system D, since a warning signal is outputted or transmitted via the wireless transmitter 62 to the control unit 90, even if output of a warning signal by light emission of the indicator portion 15 is dispensed with, security monitoring can be accomplished.

Figure 4:
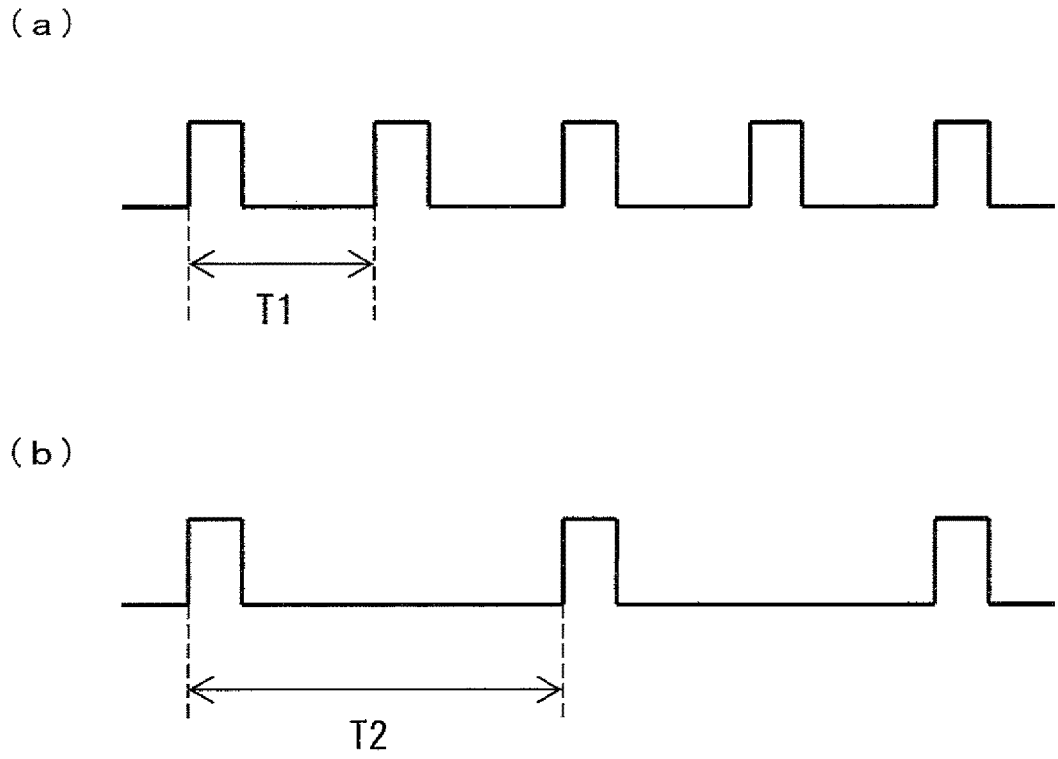
FIG. 4 is timing charts of a transmission signal in the security sensor system in FIG. 1, in which chart (a) and chart (b) show timing in a normal mode and in a suppression mode, respectively.

In the suppression mode, upon reception of an object detection signal from the object detection determiner 34, the second controller 29 may change output to the output terminal portion 17. That is, whereas, in the normal mode, upon reception of an object detection signal from the object detection determiner 34, the second controller 29 outputs or supplies a signal to the wireless transmitter 62 such that the warning signal having the interval T1 shown in chart (a) of FIG. 4 is transmitted to the wireless receiver 91 of the control unit 90; in the suppression mode, the second controller 29 outputs or supplies a signal to the wireless transmitter 62 such that a warning signal having a longer interval T2 shown in chart (b) of FIG. 4 is transmitted to the wireless receiver 91 of the control unit 90. Thus, the power consumption of the battery 64 by the wireless transmitter 62 can be suppressed. However, lengthening the interval T1 to T2 is performed only if the battery saving function is enabled. If the battery saving function is disabled, the interval of the signal from the wireless transmitter 62 remains as T1. That is, in the case that the battery saving function is disabled, even if the operation mode is switched to the suppression mode, an intermittent signal outputted from the wireless transmitter 62 remains at the interval T1 shown in chart (a) of FIG. 4 without changing. On the other hand, if the battery saving function is enabled, it is possible to suppress the battery power consumption caused by transmission from the wireless transmitter 62.

In the suppression mode, output of a signal from the second controller 29 via the output terminal portion 17 to the wireless transmitter 62 which signal containing intermittent pulses may be repeated a certain number of times and then stopped.

The security sensor system D according to the present embodiment is not limited to an AIR type object detection device. The system D may also include an MW (microwave) sensor. Even if, microwaves are used instead of infrared rays, the other configuration and operation are the same.

It should be noted that the beam projecting unit 1 may include any number of the beam projector 1*a* or 1*b*, which may include any number of the light emitting element 3. The same applies to the beam receiving unit 2.

A security sensor system according to a second embodiment of the present invention will be described. Components that are the same as those in the first embodiment are designated by the same reference numerals and the description thereof is omitted.

Figure 6:
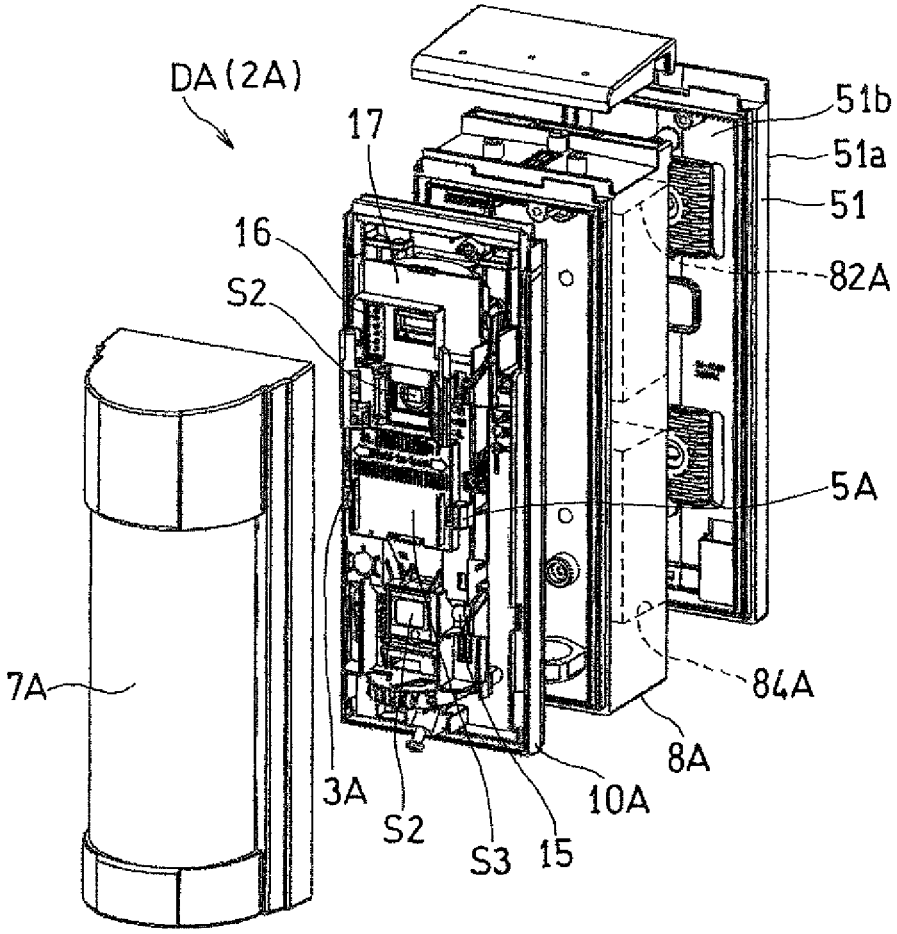
FIG. 6 is an exploded perspective view showing a security sensor system according to a second embodiment of the present invention.

As shown in FIG. 6, a security sensor system DA according to the present embodiment also detects an object such as a human body to provide an alarm, that is, to output a warning signal. The system D1 includes a single sensor unit 2A. FIG. 6 shows an exploded perspective view of the sensor unit 2A, but the sensor unit 2A is integrally constructed when the security sensor system DA operates.

The sensor unit 2A includes a back plate 51, a back box 8A, a sensor body 10A, and a sensor covering 7A. A back surface 51*a* of the back plate 51 is mounted to a to-be mounted portion K (FIG. 1). The back box 8A has an opening in a back portion thereof and includes a wireless transmitter accommodation portion 82A which accommodates a wireless transmitter 62 (FIG. 2) and a battery holder 84A which holds a battery 64 (FIG. 2). The battery 64 functions as a driving power supply. In a state where the wireless transmitter accommodation portion 82A accommodates a wireless transmitter 62 (FIG. 2) and the battery holder 84A holds the battery 64 (FIG. 2), the back box 8A is mounted to the front side of the back plate 51.

To the front side of the back box 8A, the sensor body 10A is mounted. Similarly to the first embodiment, the sensor body 10A includes therein a circuit board including a microcomputer. In addition, in the sensor body 10A, two PIR sensors (light receiving elements) S2, S2 are mounted in the vertical direction, and an MW sensor S3 is mounted between these two PIR sensors S2, S2.

In the sensor body 10A, a light emitting element 3A and a light receiving element 5A for an anti-masking function described later are mounted. The sensor body 10A further includes an indicator portion 15, an input interface portion 16, and an output terminal portion 17.

A front surface of the sensor body 10A is covered with the sensor covering 7A which allows microwaves to pass therethrough. A light receiving lens (not shown) is formed on each of front surfaces of the PIR sensors S2, S2.

Figure 7:
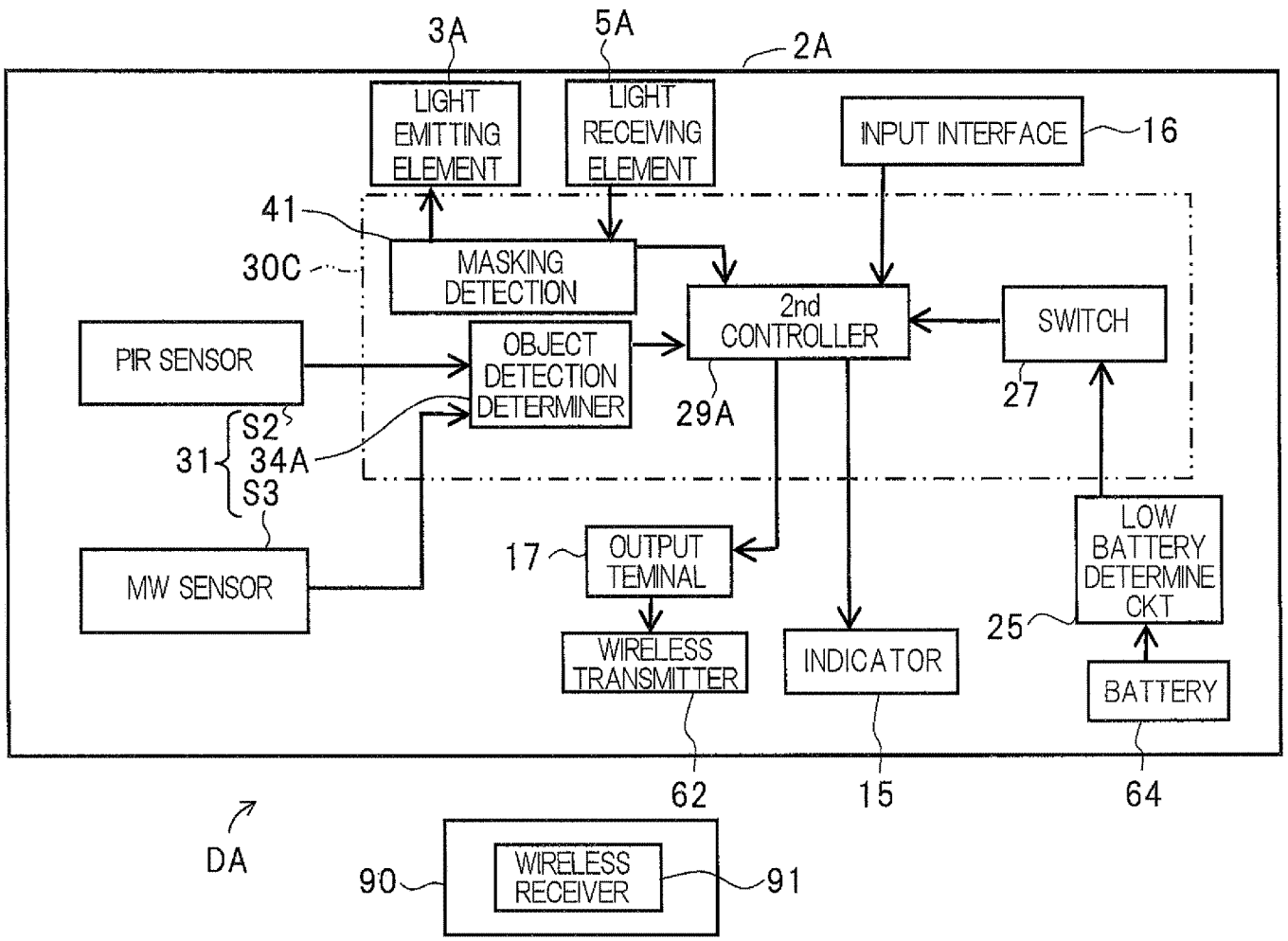
FIG. 7 is a schematic block diagram of the security sensor system in FIG. 6.

As shown in FIG. 7, the sensor body 10A (FIG. 6) of the sensor unit 2A includes the indicator portion 15, the input interface portion 16, the output terminal portion 17, a second controller 29A, a low battery determination circuit 25, an operation mode switcher 27, an object detection determiner 34A, the PIR sensors S2, and the MW sensor S3. The sensor unit 2A is also provided with a masking detection portion 41. The second controller 29A, the operation mode switcher 27, the object detection determiner 34A, and the masking detection portion 41 are implemented in a single microcomputer 30C. Although the sensor unit 2A includes the two PIR sensors S2 as described above, only one of the PIR sensors S2 is illustrated in FIG. 7 for the sake of simplification.

Each PIR sensor S2 includes a light receiving element (not shown) and an amplifier circuit (not shown). The sensor S2 receives a far-infrared ray which is an electromagnetic wave from an object within a detection area, and then supplies a PIR sensor signal to the object detection determiner 34A. The MW sensor S3 emits, toward the detection area, a microwave which is an electromagnetic wave having a wavelength longer than those of visible rays, and receives a reflected wave from an object. Specifically, the MW sensor S3 detects characteristics of a moving object such as the shape and the speed thereof by using, for example, the Doppler effect, and then supplies an MW sensor signal to the object detection determiner 34A.

The object detection determiner 34A compares the MW sensor signal and the PIR sensor signal with respective detection levels which are set for the MW sensor signal and the PIR sensor signal, respectively, so as to determine whether an object is detected by each of the sensors S2, S3. If the object detection determiner 34A determines that an object is detected by both of the sensors S2, S3, the object detection determiner 34A supplies an object detection signal to the second controller 29A. In the present embodiment, an object sensor 31 that serves as an object detection function includes the sensors PIR and MW and the object detection determiner 34. Since a result of the determination based on both of the detection signals, not one of the detection signals, is used as described above, a false alarm rarely occurs. The object detection determiner 34A may determine that an object is detected by only either sensor S2 (S3) to supply an object detection signal to the second controller 29A. By using the detection signals of the sensors S2, S3 having different detection methods as described above, a possibility of missing of an alarm is reduced.

The masking detection portion 41 performing an anti-masking function detects masking when a lens front surface is shielded in an obstructive manner by, for example, attaching a shield object such as a tape or a paper at the outside of the sensor covering 7A (FIG. 6) and near the lens front surface. In order to perform the anti-masking function, the sensor unit 2A includes the light emitting element 3A and the light receiving element 5A, and which emits and receives infrared rays IR, respectively, are performed periodically.

Regarding an object detection operation of the security sensor system DA according to the present embodiment in a suppression mode after detection of a low battery state, the differences from the first embodiment will be described.

When the low battery determination circuit 25 detects a low battery state of the battery 64 and a low battery detection signal is supplied to the operation mode switcher 27, the operation mode switcher 27 switches the operation mode from the normal mode to the suppression mode.

In the suppression mode, the second controller 29A leaves off emission of microwaves in the MW sensor S3. Accordingly, the object detection determiner 34A changes a determination condition for object detection to compare only the PIR sensor signal with a detection level which is set therefor. Upon reception of an infrared ray having a level equal to or higher than the detection level, the object detection determiner 34A determines that an object is detected to supply an object detection signal to the second controller 29A.

By leaving off the MW sensor S3, which greatly consumes the power of the battery 64, as described above, the power consumption of the battery 64 is suppressed. In the normal mode, since an object is detected with a combination of the PIR sensor S2 and the MW sensor S3, a false alarm or missing of an alarm rarely occurs as described above. However, even with the PIR sensor S2 alone, a false alarm or missing of an alarm does not always occur to an unacceptable extent.

In the suppression mode, light emission from the light emitting element 3A connected to the masking detection portion 41 is also limited. Specifically, the power from the light emitting element 3A may be reduced by using the method described with reference to charts (a) to (d) FIG. 5 for reducing the power of the detection beam IR, thereby limiting the light emission. Alternatively, the light emission from the light emitting element 3A itself may be left off due to the fact that the anti-masking function can be dispensed with since the anti-masking function is an auxiliary function. By limiting the anti-masking function, which is an auxiliary function of the device DA but greatly consumes the battery 64, as described above, it is possible to suppress the power consumption of the battery 64. Although, when the power of the masking detection portion 41 is reduced, it becomes difficult to detect the above shield object, the above shield object is not undetectable at all. It should be noted that the infrared rays are exemplified as the detection beams in the anti-masking function, but the detection beams in the anti-masking function are not limited thereto. For example, the detection beams may be microwaves, lasers, or ultrasonic waves.

Similarly to the first embodiment, the security sensor system DA according to the present embodiment includes a battery saving function interface. If a battery saving function is disabled, regardless of the normal mode or the suppression mode, a warning signal is surely and immediately transmitted or outputted by the wireless transmitter 62 when the PIR sensor S2 detects an object. On the contrary, if the battery saving function is enabled during a predetermined period after the PIR sensor S2 detects an object, a warning signal is not transmitted or outputted even when an object is detected. The predetermined period is, for example, 5 seconds in the normal mode and 120 seconds in the suppression mode. As described above, whereas, if the battery saving function is disabled, a warning signal is outputted each time an object is detected; if the battery saving function is enabled, no warning signal is outputted even when an object is detected, and when the predetermined period is expired the signal is outputted. Thus, it is possible to suppress battery power consumption. In addition, if the battery saving function is enabled, it is possible to suppress battery power consumption in the suppression mode by making the predetermined period (a period during which no warning signal is outputted even when an object is detected) in the suppression mode longer than that in the normal mode.

It should be noted that in the present embodiment, the MW sensor S3 among the PIR sensor S2 and the MW sensor S3 is left off after detection of a low battery state. Instead, the PIR sensor S2 may be left off. However, since the power consumption of the MW sensor S3 is greater than that of the PIR sensor S2, it is possible to more effectively suppress the power consumption of the battery 64 when the MW sensor S3 is left off.

The security sensor system according to the present embodiment is configured with a combination of the PIR sensor S2 and the MW sensor S3, but may be configured with any other two sensors. For example, the security sensor system may be configured with a combination of an AIR sensor and an MW sensor. In this case, the AIR sensor and the MW sensor transmit detection beams, and thus the significant battery power is consumed by the sensors. As such, in the suppression mode, even if either sensor is left off, the power consumption of the battery 64 is sufficiently suppressed.

As a combination of sensors, other than the above, two PIR sensors disposed in the vertical direction may be combined. As such a security sensor system, there is a security sensor system in which one of the PIR sensors is stopped when a noise signal is detected (JP Laid-open Patent Publication No. 2012-018034). In the suppression mode, when one of the PIR sensors is stopped through the same operation as that when a noise signal is detected, it is possible to suppress the power consumption of the battery 64.

In the sensor unit 2A according to the present embodiment, the above-described anti-masking function may be dispensed with since it is an auxiliary function.

The security sensor system according to the present embodiment is configured with a combination of the PIR sensor S2 and the MW sensor S3, but the MW sensor S3 may be dispensed with and the security sensor system may be configured with only the PIR sensor S2.

In each embodiment described above, of the respective above-described operations changed as a result of switching from the normal mode to the suppression mode, all the operations may not be changed, and only any one or more of the operations may be changed. However, if all the operations are changed, it is possible to effectively suppress battery power consumption. Which operations of the plurality of the operations are changed may be designated by a user through a switch which is not shown. For example, a user is allowed to select not leaving off monitoring of an event of a manipulation performed by a user on an input interface, not changing an interval of signal transmission for alive monitoring, or the like.

In each embodiment described above, examples of the sensors included in the security sensor system include the AIR sensor, the PIR sensor, and the MW sensor, but are not limited thereto. For example, a laser sensor and an ultrasonic sensor may be included. In addition, the security sensor system may include only a single type of sensors as in the first embodiment described above, or a combination of a plurality of types of sensors as in the second embodiment described above.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

REFERENCE NUMERALS

15, 62: output interface module
28 first controller
29, 29A second controller
25 low battery detector
27 operation mode switcher
31 object sensor
64 battery
D, DA security sensor system

What is claimed is:

1. A security sensor system powered by a battery, the security sensor system comprising:

an object sensor to generate an object detection signal when detecting an object;

an output interface module to provide a warning signal:

a controller to receive the object detection signal generated by the object sensor, the controller controlling the output interface module in accordance with the object detection signal to cause the output interface module to output the warning signal;

a microcomputer in which the controller is implemented;

a low battery detector to detect a reduction in a voltage of the battery; and an operation mode switcher to switch an object detection operation of the security sensor system from a normal mode in which the system operates with a margin to avoid a false alarm or missing of an alarm to a first suppression mode when the low battery detector detects a reduction in the voltage of the battery, consumption of the battery in the first suppression mode being suppressed, the suppression of the consumption of the battery being such that object detection is possible with object detection performance reduced from the normal mode but minimizing the occurrence of a false alarm or missing of an alarm, the object detection operation being detecting a human body, wherein by lengthening a period of sampling, in the microcomputer, of the object detection signal supplied to the controller, the operation mode switcher switches the object detection operation of the security sensor system from the normal mode to the first suppression mode.

2. A security sensor system powered by a battery, the security sensor system comprising:

an object sensor to generate an object detection signal when detecting an object;

an output interface module to provide a warning signal;

a controller to receive the object detection signal generated by the object sensor, the controller controlling the output interface module in accordance with the object detection signal to cause the output interface module to output the warning signal;

a low battery detector to detect a reduction in a voltage of the battery;

an operation mode switcher to switch an object detection operation of the security sensor system from a normal mode in which the system operates with a margin to avoid a false alarm or missing of an alarm to a first suppression mode when the low battery detector detects a reduction in the voltage of the battery, consumption of the battery in the first suppression mode being suppressed, the suppression of the consumption of the battery being such that object detection is possible with object detection performance reduced from the normal mode but minimizing the occurrence of a false alarm or missing of an alarm; and an input interface module to accept an input concerning an operation condition of the security sensor system, wherein the controller monitors the input accepted by the input interface module while the object detection operation is in the normal mode, and by leaving off the monitoring of the input, the operation mode switcher switches the object detection operation of the security sensor system from the normal mode to a second suppression mode, consumption of the battery in the second suppression mode being suppressed, but the second suppression mode being different from the first suppression mode.

3. A security sensor system powered by a battery, the security sensor system comprising:

an object sensor to generate an object detection signal when detecting an object;

an output interface module to provide a warning signal;

a controller to receive the object detection signal generated by the object sensor, the controller controlling the output interface module in accordance with the object detection signal to cause the output interface module to output the warning signal;

a low battery detector to detect a reduction in a voltage of the battery; and an operation mode switcher to switch an object detection operation of the security sensor system from a normal mode in which the system operates with a margin to avoid a false alarm or missing of an alarm to a first suppression mode when the low battery detector detects a reduction in the voltage of the battery, consumption of the battery in the first suppression mode being suppressed, the suppression of the consumption of the battery being such that object detection is possible with object detection performance reduced from the normal mode but minimizing the occurrence of a false alarm or missing of an alarm, the object detection operation being detecting a human body, wherein the object sensor includes a first object detection portion and a second object detection portion, the first and second object detection portions being operated in the normal mode to detect an object, and by leaving off either one of the first and second object detection portions, the operation mode switcher switches the object detection operation of the security sensor system from the normal mode to the first suppression mode, such that, in the first suppression mode, the object sensor determines that an object is detected when the other object detection portion of the first and second object detection portions detects an object.

4. A security sensor system powered by a battery, the security sensor system comprising:

an object sensor to generate an object detection signal when detecting an object;

an output interface module to provide a warning signal;

a controller to receive the object detection signal generated by the object sensor, the controller controlling the output interface module in accordance with the object detection signal to cause the output interface module to output the warning signal;

a low battery detector to detect a reduction in a voltage of the battery; and an operation mode switcher to switch an object detection operation of the security sensor system from a normal mode in which the system operates with a margin to avoid a false alarm or missing of an alarm to a first suppression mode when the low battery detector detects a reduction in the voltage of the battery, consumption of the battery in the first suppression mode being suppressed, the suppression of the consumption of the battery being such that object detection is possible with object detection performance reduced from the normal mode but minimizing the occurrence of a false alarm or missing of an alarm, the object detection operation being detecting a human body, wherein the object sensor includes:

a detection beam projector that intermittently transmits a detection beam for object detection toward a detection area; and a detection beam receiver that receives the detection beam, the object sensor includes an active type object sensor that detects an object on the basis of the shield or reflection of the detection beam by the object to generate the object detection signal, and by controlling the detection beam projector so as to execute at least one of: decreasing an amplitude of the detection beam; lengthening an interval of the intermittent detection beam;

and shortening an output time of the detection beam, the operation mode switcher switches the object detection operation of the security sensor system from the normal mode to the first suppression mode.

5. The security sensor system as claimed in claim 4, further comprising:

an amplifier to amplify a detection beam reception signal supplied by the detection beam receiver; and an automatic gain control circuit to adjust a gain of the amplifier, wherein by reducing a range of adjustment of the gain by the automatic gain control circuit, the operation mode switcher switches the object detection operation of the security sensor system from the normal mode to the first suppression mode.

6. A security sensor system powered by a battery, the security sensor system comprising:

an object sensor to generate an object detection signal when detecting an object, the object sensor including an infrared receiver that receives an infrared ray emitted by an object within a detection area, and the object sensor including a passive type object sensor that detects an object on the basis of the received infrared ray to generate the object detection signal;

an output interface module to provide a warning signal;

a controller to receive the object detection signal generated by the object sensor, the controller controlling the output interface module in accordance with the object detection signal to cause the output interface module to output the warning signal;

a low battery detector to detect a reduction in a voltage of the battery;

an operation mode switcher to switch an object detection operation of the security sensor system from a normal mode in which the system operates with a margin to avoid a false alarm or missing of an alarm to a first suppression mode when the low battery detector detects a reduction in the voltage of the battery, consumption of the battery in the first suppression mode being suppressed, the suppression of the consumption of the battery being such that object detection is possible with object detection performance reduced from the normal mode but minimizing the occurrence of a false alarm or missing of an alarm; and a masking detector to detect a reflected beam from an object, wherein by limiting the masking detection function of the masking detector, the operation mode switcher switches the object detection operation of the security sensor system from the normal mode to a third suppression mode, consumption of the battery in the third suppression mode being suppressed, but the third suppression mode being different from the first suppression mode.

7. A security sensor system powered by a battery, the security sensor system comprising:

an object sensor to generate an object detection signal when detecting an object;

an output interface module to provide a warning signal;

a controller to receive the object detection signal generated by the object sensor, the controller controlling the output interface module in accordance with the object detection signal to cause the output interface module to output the warning signal;

a low battery detector to detect a reduction in a voltage of the battery; and an operation mode switcher to switch an object detection operation of the security sensor system from a normal mode in which the system operates with a margin to avoid a false alarm or missing of an alarm to a first suppression mode when the low battery detector detects a reduction in the voltage of the battery, consumption of the battery in the first suppression mode being suppressed, the suppression of the consumption of the battery being such that object detection is possible with object detection performance reduced from the normal mode but minimizing the occurrence of a false alarm or missing of an alarm, wherein the warning signal is wirelessly transmitted as a pulse signal having a predetermined interval, via a wireless transmitter, and by controlling the output interface module so as to execute at least one of: lengthening the predetermined interval; and wirelessly transmitting the pulse signal only a certain number of times before leaving off the transmission, the operation mode switcher switches the object detection operation of the security sensor system from the normal mode to a fourth suppression mode, consumption of the battery in the fourth suppression mode being suppressed, but the fourth suppression mode being different from the first suppression mode.

8. The security sensor system as claimed in claim 7, further comprising a battery saving function input interface to accept an input of either one of enablement and disablement, wherein only if the battery saving function input interface is enabled, the operation mode switcher switches the object detection operation of the security sensor system from the normal mode to a fifth suppression mode, consumption of the battery in the fifth suppression mode being suppressed, but the fifth suppression mode being different from the first suppression mode.

9. The security sensor system as claimed in claim 7, wherein the output interface module includes an indicator that provides the warning signal as a visible display, and by leaving off the visible display of the warning signal, the operation mode switcher switches the object detection operation of the security sensor system from the normal mode to a sixth suppression mode, consumption of the battery in the sixth suppression mode being suppressed, but the sixth suppression mode being different from the first suppression mode.

* * * * *